US006598319B2

(12) United States Patent
Hardt

(10) Patent No.: US 6,598,319 B2
(45) Date of Patent: Jul. 29, 2003

(54) INSOLE WITH REBOUNDING AND CUSHIONING AREAS AND ADJUSTABLE ARCH SUPPORT

(75) Inventor: John C. Hardt, Belton, TX (US)

(73) Assignee: Spenco Medical Corporation, Waco, TX (US)

( * ) Notice: Subject to any disclaimer, the term of this patent is extended or adjusted under 35 U.S.C. 154(b) by 0 days.

(21) Appl. No.: 09/764,171

(22) Filed: Jan. 17, 2001

(65) Prior Publication Data

US 2002/0092203 A1 Jul. 18, 2002

(51) Int. Cl.[7] ..... A43B 13/18; A43B 13/40

(52) U.S. Cl. ..... 36/28; 36/43; 36/91; 36/153; 36/155

(58) Field of Search ..... 36/28, 43, 91, 36/153, 155, 160, 163

(56) References Cited

U.S. PATENT DOCUMENTS

| | | | | | |
|---|---|---|---|---|---|
| 632,529 | A | * | 9/1899 | Korwan | 36/147 |
| 1,605,985 | A | | 11/1926 | Rasmussen | |
| 2,304,384 | A | * | 12/1942 | Stemmons | 36/155 |
| 2,311,925 | A | * | 2/1943 | Boos | 36/163 |
| 3,548,420 | A | * | 12/1970 | Spence | 36/71 |
| 4,139,337 | A | | 2/1979 | David et al. | 425/2 |
| 4,263,728 | A | | 4/1981 | Frecentese | 36/129 |
| 4,453,322 | A | | 6/1984 | Marsh | 36/11.5 |
| 4,813,157 | A | * | 3/1989 | Boisvert et al. | 36/145 |
| 4,876,758 | A | | 10/1989 | Rolloff et al. | 12/142 N |
| 4,888,841 | A | | 12/1989 | Cumberland | 12/38 |
| 4,910,886 | A | * | 3/1990 | Sullivan et al. | 36/43 |
| 5,027,461 | A | | 7/1991 | Cumberland | 12/142 N |
| 5,068,983 | A | * | 12/1991 | Marc | 36/44 |
| 5,138,774 | A | * | 8/1992 | Sarkozi | 36/159 |
| 5,203,793 | A | * | 4/1993 | Lyden | 12/142 N |
| 5,408,761 | A | | 4/1995 | Gazzano | 36/88 |
| 5,430,960 | A | | 7/1995 | Richardson | 36/89 |
| 5,640,779 | A | | 6/1997 | Rolloff et al. | 33/514.2 |
| 5,714,098 | A | | 2/1998 | Potter | 264/40.1 |
| 5,722,186 | A | | 3/1998 | Brown | 36/43 |
| 5,732,481 | A | | 3/1998 | Farhad | 36/44 |
| 5,846,063 | A | | 12/1998 | Lakic | 417/440 |
| 5,879,725 | A | | 3/1999 | Potter | 425/403 |
| 6,176,025 | B1 | * | 1/2001 | Patterson et al. | 36/28 |

FOREIGN PATENT DOCUMENTS

| | | | | |
|---|---|---|---|---|
| DE | 20011334 | | 12/2000 | A34B/17/02 |
| EP | 060353 | * | 9/1982 | |
| EP | 0759276 | | 2/1997 | A34B/13/04 |
| WO | 0072714 | | 12/2000 | A34B/13/18 |

* cited by examiner

*Primary Examiner*—Ted Kavanaugh
(74) *Attorney, Agent, or Firm*—Sidley, Austin, Brown & Wood LLP

(57) ABSTRACT

An insole of a sheet material of polymeric foam material having two openings therein corresponding to a portion of the heel and a portion of the arch. The openings are filled with a polymeric gel composition having a tacky bottom surface to assist holding the insole in place and for the removable attachment of a polymeric gel arch cushion.

9 Claims, 3 Drawing Sheets

INSOLE WITH REBOUNDING AND CUSHIONING AREAS AND ADJUSTABLE ARCH SUPPORT

TECHNICAL FIELD

The present invention relates to insoles having a portion constructed from a rebounding material and a portion constructed from a cushioning gel polymeric material, and a removable arch cushion.

BACKGROUND OF THE INVENTION

In the footwear industry, insoles are well known. Insoles can be an integral part of the piece of footwear as a permanent part of a shoe, or can be a removable portion of a piece of footwear when it is manufactured. Insoles can also be of an after-market product to be inserted into footwear by a consumer, or as replacements for insoles which wear out. These after market insoles can be either an addition to the insoles originally contained in the footwear, or a replacement for the insoles contained in the original footwear product. In the last two decades, there has been much attention to the design and manufacture of shoes and insoles for specific applications, usually athletics, such as jogging and tennis. These efforts have focused primarily on athletic and sport applications in an attempt to tailor the shape and characteristics of the insole to meet the demands placed on the foot from the type of movements most common to a particular sport. In spite of this increased attention to designing an insole for a particular application, there has been little attention given to the design of insoles for people who stand for long periods of time. Thus there has been a continuing need for an insole especially constructed to address the concerns and needs of persons who are on their feet for substantial periods of time but who do not place a great deal of extraordinary stress on their feet from athletic activities. Such persons include factory workers, retail sales clerks, construction workers, etc.

Two of the most common foot ailments are bone spurs in the heel and fallen arches or flat feet. These ailments produce serious discomfort to persons who are on their feet for extended periods of time. The present invention is especially designed for those who are on their feet for significant periods and who have bone spurs, fallen arches, or both. The invention has the advantage of providing cushioning to the heel and/or arch areas while providing rebound characteristics to other portions of the foot, thereby enhancing comfort during long periods of activity.

The present invention also provides a method to produce such insoles in an economical fashion. Further, the present invention provides insoles in which the arch support may be positioned to suit individual preferences of the user.

BRIEF DESCRIPTION OF THE DRAWINGS

The preferred embodiments of the invention will be more readily understood with reference to the following drawings.

SUMMARY OF THE INVENTION

In one aspect, the present invention relates to an insole construction from a sheet of polymeric foam material with openings in the arch and/or heel areas which are filled with a polymeric gel. In a preferred embodiment, the foam is a substantially closed cell polymeric foam, such as neoprene. The polymeric gel has a thickness substantially the same as the thickness of the sheet of polymeric foam material. In a preferred embodiment, the sheet of polymeric foam material has a fabric cover attached to its top surface. The polymeric gel preferably has a textured surface on top and a tacky surface on the bottom.

In another aspect, the present invention relates to an insole constructed as described above but in which a portion of the polymeric gel extends beyond the upper or lower surface of a sheet of polymeric foam, the extension being in the shape of the arch area of a foot.

In yet another aspect, the invention relates to an insole made from a sheet of polymeric foam having openings which are filled with a polymeric gel which has substantially the same thickness of the polymeric foam and a removable arch cushion of polymeric gel. In the preferred embodiment, the arch cushion has at least a portion of its surface which is tacky to allow it to be adhered to the insole sheet.

DETAILED DESCRIPTION

Figure 1:
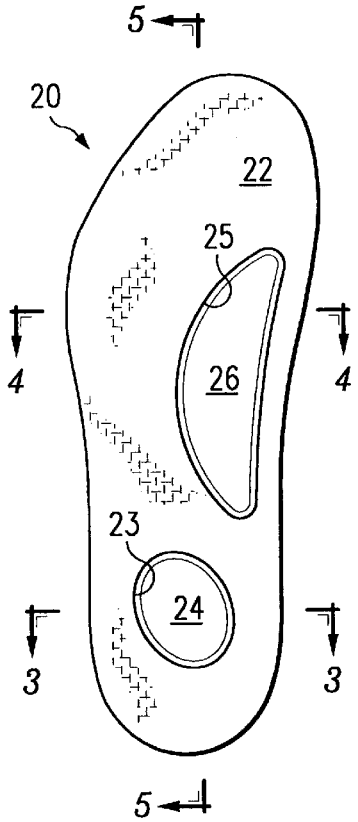
FIG. 1 is a top view of a full insole of the invention.

Reference will now be made in detail to preferred embodiments of the present inventions, examples of which are illustrated in the accompanying drawings. Like numbers in the drawings refer to like items. FIG. 1 is a top view of insole 20. Insole 20 is made of sheet material 22 in the shape of an insole or outline of a foot. Sheet material 20 can be of different constructions as is discussed below. In the preferred embodiment, insole 20 defines a heel opening 23 which receives has a heel plug 24 and defines an arch opening 25 which receives an arch plug 26 in the arch area 25.

Figure 2:
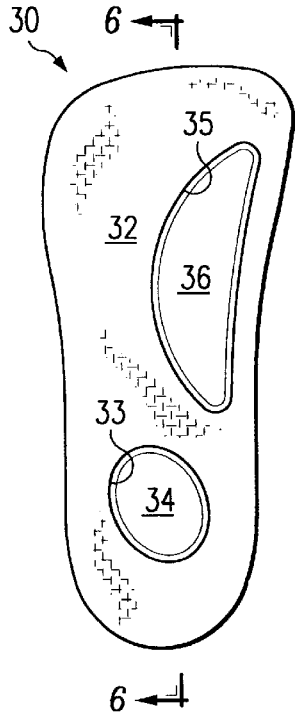
FIG. 2 is a top view of a partial or ¾ insole of the invention.

The present invention may be a full insole as illustrated by insole 20 as illustrated in FIG. 1 or a partial insole such as the three-quarter insole 30 as illustrated in FIG. 2. Three-quarter insole 30 is made of a sheet material 32 and which in the preferred embodiment, defines a heel opening 33 receiving a heel plug 34 and arch opening 35 receiving an arch plug 36.

In the preferred embodiment, the sheet material 22, and 32 is a substantially closed cell polymeric foam material. Preferably the material is neoprene. The sheet material 22 can also be an opening cell foamed polymer, such as polyurethane. A substantially closed cell material is one in which the majority of bubbles within the foamed polymeric material are entirely encapsulated by polymeric material. These materials are preferred because they provide excellent rebound or spring back characteristics when compressed and released.

When the foam material is compressed, it has a tendency to spring back to the uncompressed state. When a user is standing on the sheet of foamed polymeric material a certain datum state is established and the material is compressed by the weight of the user This compression differs about the insole corresponding to the weight being supported by various portions of the foot. As the user moves his feet or shifts his weight, he will change the areas of localized pressure increasing the compression in different areas of the sheet material and reducing it in other areas, which will cause the sheet of polymeric foam material to seek to rebound in those areas. The foam material provides shock absorption as the foam is compressed. A preferred foam material is neoprene which has a hardness from about 40 to about 65 on the "00" Shore Hardness scale. Preferably, the Shore Hardness is 52–56.

The Shore hardness is measured with a commercially available Shore tester. The material to be tested is placed on a hard flat surface. The Shore tester is equipped with an "00" gauge with plunger post and weight. The plunger post is approximately 0.090 inches in diameter and a 400 gram weight is added. The plunger post is positioned up and out of the way. The Shore tester is placed on the material to be tested, the plunger released and the reading taken. It is preferred to take measurements in three different areas and average the result.

The total thickness of the sheet material 22, 32 can vary depending on application and whether the insole is a removable insole or a permanent insole. The invention is being described in relation to the preferred embodiments which are replaceable insoles. Sheet material preferably has a thickness of about 3/32 to about 8/32 inches and most preferably about 5/32 inches. The thickness of the sheet material usually should not exceed 8/32 inches.

The invention provides different degrees of cushioning, support, and energy return to selected specific areas of the foot. The heel opening 23, 33 is located at the heel. In the preferred embodiment, the opening is anatomically shaped and tilted to the medial side of the calcaneous. This is the portion of a person's heel that is susceptible to heel pain due to compression and atrophy of the plantar fat pad under the heel. Also, this is the portion of the heel where heel spurs or bone spurs tend to occur. The arch opening 25, 35 is located distal to the medial aspect of where the calcaneous would sit and ending at a point under the first metatarsal head. Preferably, the arch opening has a generally crescent shape.

Figure 3:
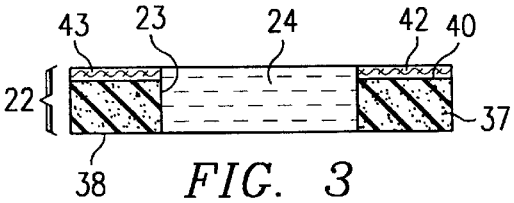
FIG. 3 is a cross-sectional view along line 3—3 of FIG. 1 of one embodiment of the present invention.
Figure 3A:
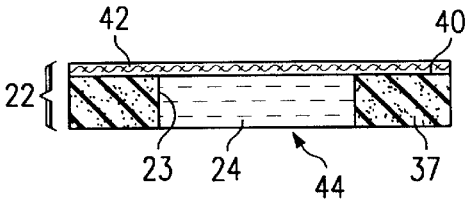
FIG. 3*a* is a cross-sectional view along line 3—3 of FIG. 1 of the present invention.
Figure 3B:
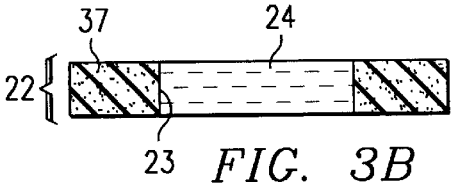
FIG. 3*b* is a cross-sectional view along line 3—3 of FIG. 1 of yet another embodiment of the present invention.

FIGS. 3, 3*a*, and 3*b* are cross-sectional views of FIG. 1 along line 3—3, representing differing constructions which are possible. Referring to FIG. 3, insole 20 in the preferred embodiment is made of the sheet material 22 having a bottom side 38 and a top side 43 and which is comprised of a sheet 37 of polymeric foam material which has a bottom side 38 and a top side 40. Adhered to the top side 40 of a polymeric foam sheet 37 is a fabric sheet 42. Fabric sheet 42 can be made from a synthetic, a natural fiber or blend thereof which will adhere to the sheet of polymeric foam material 37. Fabric cover 42 is used in the preferred embodiment because a fabric cover can provide desirable characteristics. In the preferred embodiment, the fabric is nylon. Nylon has a low coefficient of friction which reduces surface wear and allows the foot to slide. Thus, nylon helps reduce the likelihood of blisters, by having a low coefficient of friction, and resistance to localized surface wear. As shown in FIG. 3, the heel plug 24 is substantially the same thickness as sheet material 22. The gel may be of any polymeric material which is substantially free of air bubbles and voids and exhibits gel properties of being deformable. In the preferred embodiment the gel is a polyurethane elastomeric gel. Polyurethane elastomeric gel has a very good cushioning and energy absorbing properties due to its dense structure. In a preferred embodiment, the polymeric gel has a Shore "00" hardness in the range of from about 20 to about 60, and preferably from about 30 to about 50; a tensile strength of from about 22 to about 40 pounds per square inch and preferably from about 27 to about 33 pounds per square inch; exhibits from about 100% to about 450% elongation and preferably from about 160% to about 390% elongation; and a compression set of from about 5.5% to about 8.5%, and preferably from about 6.5% to about 7.9%.

In the preferred embodiment, the polymeric foam material or sheet 37 when manufactured is bonded to fabric layer 42. (In the figures, the thickness of fabric layer 42 is exaggerated for purposes of illustration.) The sheet material is die cut in the shape of the insole. As used herein, insole will refer to a full insole or a partial insole. And the heel opening 23 for the heel plug 24 and the opening 25 for the arch plug 26 are die cut. The insole sheet 22, 32 is then laid in an open mold with the top 43 of the sheet 22 resting on the bottom of the mold with the bottom 38 of sheet 22 facing up. The gel material is then placed in the openings 23, 33 and 25, 35. In the preferred method, a ratio mixture of a polyurethane resin and an isocyanate catalyst is poured into the openings 23, 33, and 25, 35. The mixture fills the opening such that when it is reacted it fills the openings to substantially the same thickness as sheet 22. The polyurethane reactive mixture will be liquid and flowable at the time it is placed in the openings 23, 33, and 25, 35. Once it reacts it will form an elastomeric gel. An elastomeric, non-foaming urethane resin is ratio mixed with an isocyanate reactant to produce a urethane visco-elastic elastomer that has excellent stability, low resilience and high tensile, tear and elongation properties. A ratio of urethane resin to isocyanate in the range of about 3.5 to 1 to 5 to 1 can be used and preferably the ratio is about 4 to 1 based on weight.

A polyurethane resin having a viscosity of about 300–400 cps and preferably 340 cps and a specific gravity of from about 0.9 to 1.1 and preferably about 1 can be used. An isocyanate catalyst having a viscosity of about 300 to 400 cps and preferably 340 cps and a specific gravity of about 0.9 to 1.2 and preferably about 1.1 can be used.

Alternatively, as shown on FIG. 3*a*, the fabric layer 42 covers the entire surface of the insole 20 and heel plug 24 is within a cavity 44 in the foam layer 37. In this embodiment, the insole 20 may be constructed by first preparing the closed cell polymeric foam sheet 37, then die cutting heel opening 23 and arch opening 25. This is followed by application of fabric cover 42 subsequent to the die cutting of the insole. This embodiment is less desirable as it is more difficult to construct. The fabric cover 42 is typically from about 0.018 inches to about 0.060 inches in thickness.

FIG. 3*b* illustrates a cross section of another embodiment of the invention which does not include a fabric cover sheet. In this embodiment, thickness of sheet 22 is the same as the thickness of the sheet of polymeric foam material 37. Heel plug 24 is substantially the same thickness as sheet 37.

The insole of FIG. 3*b* can be made by die cutting the insole shape and openings for the heel plug 24 and the arch area 26 in the sheet 37. The cutting operations can be done in single or multiple cutting steps. Further, the present invention includes insoles with an arch plug, and also includes an insole with both an arch plug and heel plug.

In any of the embodiments illustrated in FIGS. 3, 3*a* and 3*b*, the manufacture of the insoles is performed by placing the cut sheet 22 in a mold which is open at the top. The bottom 38 of sheet 22 faces up in the mold. A sufficient volume of polyurethane reactive mixture is deposited within the openings for the heel plug 24 and arch support 26 such that when the polyurethane gel reactants are reacted, the gel formed thereby has substantially the same thickness as sheet material 22. Alternative methods of construct include press fitting an elastromeric gel within the openings or placing cut out gel plugs in a mold and molding the polymeric foam material around the plugs.

In the preferred embodiment, the bottom of the die which receives the top of the insole 20 has a diamond or other textured pattern. When the liquid polyurethane mixture is placed within the heel plug and arch area openings 23, 33 and 25, 35, it will flow to fill the opening and have a smooth surface, and when reacted the gel will have a smooth surface. It has been found that a smooth gel surface is more tacky than a textured surface for a given gel composition. Of course the degree of tackiness exhibited by the gel is also effected by the gel composition selected. In the preferred embodiment, the gel will have a textured shape on the top surface 43 of arch plug 26 and/or the top surface 23 of the heel plug 24 from the textured surface of the mold. The bottom surface of the heel and arch plugs 24, 34 and 26, 36 of insole 20, 30 will be relatively smooth and exhibit a good degree of tackiness. The top of the heel plug 24 and arch plug 26 may be tacky if desired but in most applications, that is less desirable. A tacky bottom surface can be desirable depending upon a number of factors. Generally, the tacky bottom surface of the gel is desirable for the heel plug because it assists holding the insole in place. As will be discussed further below, a tacky bottom to the arch plug 26 is desirable both to hold the insole in place and to permit placement of the arch cushion or support.

In the preferred embodiment, the polyurethane gel reactants when reacted will exhibit some degree of tackiness. The degree of tackiness depends upon several factors including the surface texture of the gel. Generally, the tackiness of the gel increases as the softness of the gel increases, and as the hardness increases the tackiness decreases. The hardness of the gel can be adjusted by adjustments to the reactants. In some cases, increasing the amount of catalyst, such as isocyanate, will increase hardness. Hardness can also be controlled by using resins of different physical properties or chemical compositions.

Tackiness can be tested according ASTM D3121. This test utilizes a test stand which has a platform and an inclined ramp mounted on the platform. At the bottom of the ramp the sample to be measured is laid out. A ruler is placed on the sample from the end of the ramp extending outward. A ball is placed at the top of the ramp and then released. The distance the ball travels across the material at the end of the ramp is used to measure tackiness. A non-adhesive 11.1 mm in diameter stainless steel ball weighing 5.6 grams is used. The test procedure can be summarized as follows. The platform base of the tester is leveled. The incline is thoroughly cleaned with alcohol and distilled water prior to testing. The sample is placed on the flat portion of the tester at the bottom of the incline such that the specimen is free of wrinkles, creases and splices. The ball is released down the incline and the length of travel of the ball from the end of the incline across the sample is measured. Measurements are taken from the end of the incline to the center of the ball in millimeters. The polymeric gel of the present invention preferably has a tackiness such that the ball travels from about 5.0 mm to about 18 mm and preferably from about 5.6 mm to about 16 mm.

Figure 4:
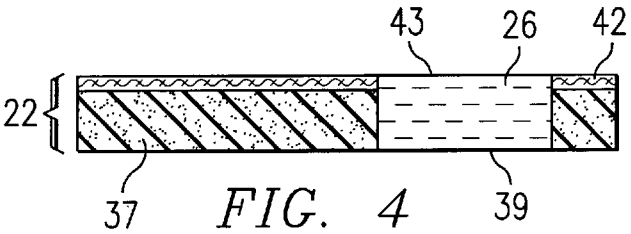
FIG. 4 is a cross-sectional view along line 4—4 of FIG. 1 of one embodiment of the present invention.

FIG. 4 is a cross section of FIG. 1 along line 4—4. It is of similar construction to FIG. 3 wherein sheet material 22 is made of polymeric foam material 37 and fabric covering 42. Arch area 26 has a top and bottom surface 43 and 38. FIG. 4 corresponds to a cross section of an insole made as described above in reference to FIG. 3. The cross section of the arch area of the insole could also reflect constructions as shown in FIGS. 3*a* and 3*b* at the heel end.

Figure 5:
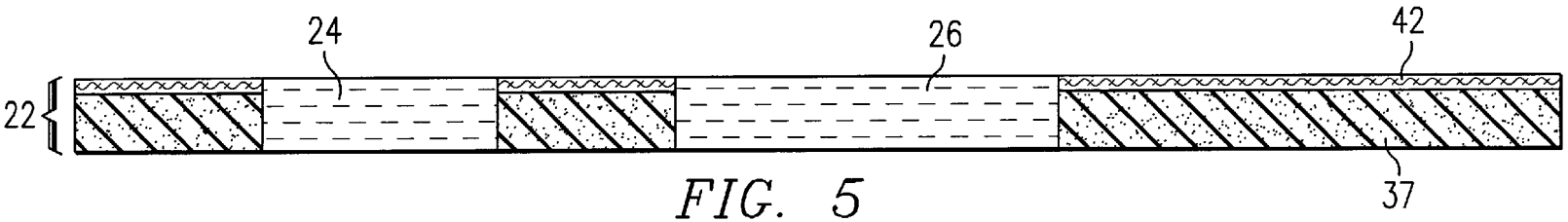
FIG. 5 is a cross-sectional view along line 5—5 of FIG. 1 of one embodiment of the present invention.
Figure 6:
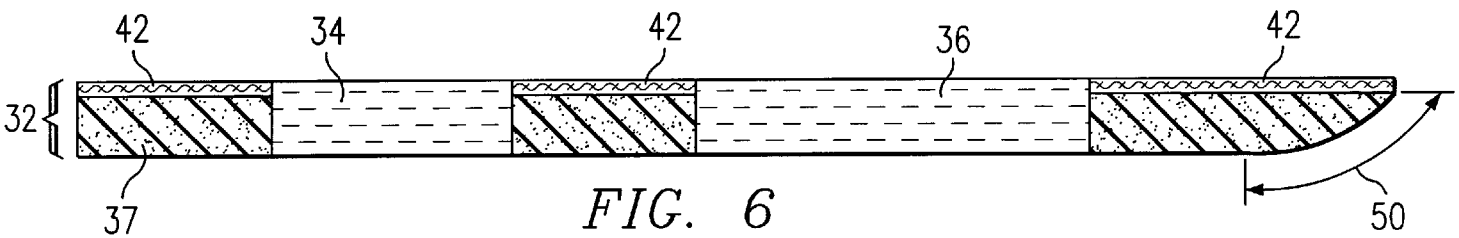
FIG. 6 is a cross-sectional view along line 6—6 of FIG. 2 of one embodiment of the present invention.

FIG. 5 is a cross-sectional view along line 5—5 of FIG. 1. As can be seen, the insole 20 has a substantially uniform thickness from heel to toe. FIG. 6 is a cross-sectional view along line 6—6 of FIG. 2, and as can be seen the insole 30 has a substantially uniform thickness, but the front portion 50 of insole 30 can be tapered at the front, so that the bottom surface tapers into the top surface. Generally, in a partial insole, it is more comfortable if the front portion is tapered so that no sharp edges are present at the front of the partial insole.

The invention does not require both the heel plug 24, 34 and the arch plug 26, 36. For some purposes, it would be sufficient to have only a heel plug and for others only the arch plug. In the preferred embodiment, both areas are included because this embodiment achieves maximum flexibility and provides one product designed to be useful for any particular customer's desires while minimizing the inventory needed to be maintained.

Figure 7:
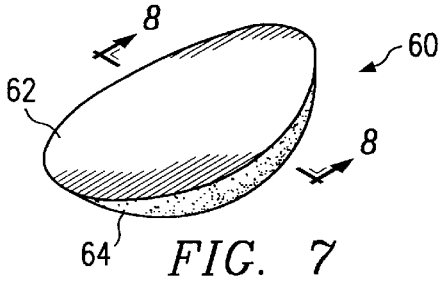
FIG. 7 is a perspective view of the arch cushion of the present invention.
Figure 8:
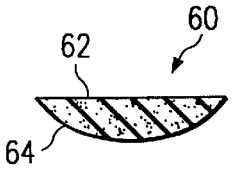
FIG. 8 is a cross-sectional view along line 8—8 of FIG. 7.

FIG. 7 is a perspective view of the arch cushion 60. The arch cushion 60 has a shape which will fill approximately the shape of the space created by a normal arch of the foot when one is standing. Generally, the arch cushion 60 has an appearance somewhat similar to one-half of a kidney bean. The upper surface 62 of the cushion is preferably flat when molded for ease of manufacture. The arch cushion 60 is preferably made from a polyurethane elastomeric gel. It can be made by forming a mold corresponding to the curved portion surface 64, filling the mold with the polyurethane gel reactants and allowing the surface tension to create a level top which when the gel reacts will become a smooth upper surface 62. In the preferred embodiment, the upper surface 62 is smooth and not textured so that it retains a high degree of tackiness. The curved lower surface 64 can be textured, partially textured, or smooth so that it possesses the desired degree of tackiness. In the preferred embodiment, a tacky flat surface 62 of the arch cushion 60 is provided that allows the arch cushion 60 to be adhered to a portion of the bottom surface of the arch plug 26, 36 of the insole sheet 22, 32. Also, it is desirable that the tackiness be such that the arch cushion 60 can be removed and relocated on the insole 20, 30. This allows the user to position the arch cushion 60 in the most comfortable position for the individual user. Alternatively, the arch cushion 60 can be molded with the flat sheet insole to produce unitary structure. This is a less desired embodiment because the customer cannot adjust the position of the arch cushion FIG. 8 is a cross sectional view of FIG. 7 along line 8—8. The cross section of arch cushion 60 is such at it will correspond approximately to the space of an arch space of normal feet when attached to insole 20, 30. In the preferred embodiment the top surface 62 of the cushion 60 is flat because of the ease of molding.

Figure 8A:
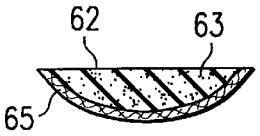
FIG. 8*a* is an alternate embodiment of FIG. 8.

FIG. 8*a* is an alternate embodiment of the arch cushion 60 shown in FIG. 8. In this embodiment, the polymeric gel 63 is covered with a fabric cover 65 (scale exaggerated for illustration). This embodiment is useful if the arch cushion 60 is attached to the top surface of the insole sheet. This embodiment is considered less preferred because an arch cushion positioned on top of the insole sheet is more likely to be dislodged when the user puts his foot into a shoe than when the arch cushion is attached to the bottom of the insole.

The arch plug 26, 36 is typically longer than the top 62 of the arch cushion 60 and the arch cushion at its widest is approximately the same width as the widest part of the top 62 of the arch cushion 60. This is preferred because it extends the length of the tacky underside of arch plug 26, 36 adding in the attachment of the arch cushion 60 in a position selected by the individual consumer. In the preferred embodiment, both the bottom surface of the arch plug 26, 36 and the upper surface 62 of the arch cushion 60 are tacky to aid in attaching the arch cushion 60 to the insole sheet 22, 32.

Figure 9:
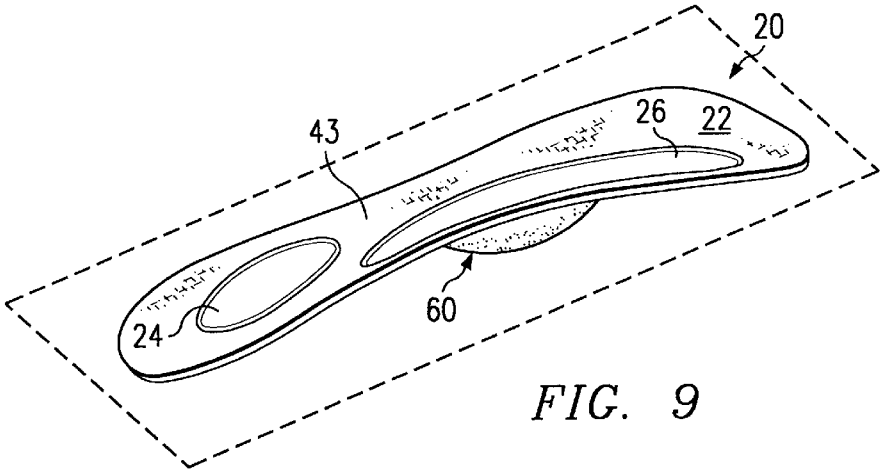
FIG. 9 is a perspective view of the insole sheet with attached an arch cushion of the present invention.

FIG. 9 is a perspective view showing the insole 20 with attached arch cushion 60. The flat surface 62 of arch cushion 60 has been adhered to the bottom 38 of arch plug 26. In the preferred embodiment arch plug 26 has a tacky bottom 38 and arch cushion 60 has a tacky top surface 62. Thus, the top 62 of arch cushion 60 can be releasably adhered to the bottom 38 of arch plug 26. This allows a user to remove and replace the arch cushion at the location most desirable for that particular user. Other means of releasably attaching the arch cushion, such as two-sided tape, to the arch plug can be employed.

Referring to FIG. 9, when arch cushion 60 is attached to the bottom of arch plug 26 the insole 20 with attached arch cushion 60 will take on a shape of the upper surface 43 of insole which is complimentary to shape of the bottom of a normal foot. As will be appreciated the shape of arch cushion 60 shown in FIG. 7 will be distorted somewhat when the arch cushion 60 is attached to the insole 20. Therefore, the arch cushion 60 is molded to have the desired resulting shape when attached to insole 20. The tacky lower surface 64 of such cushion 60 is useful to keep the insole in place in a piece of footwear.

In an alternate embodiment of the invention, the arch cushion 60 and arch plug 26, 36 may be molded as a single piece. This is less preferred embodiment because the arch cushion can not be repositioned by the user to meet the needs of the individual user.

An elastomeric polymeric gel useful in the present invention is a gel with a hardness of from about 30 to about 50 on a "00" Shore hardness scale. Preferably, the gel has an hardness of from about 38 to 42 on the "00" Shore hardness scale. This measurement is made using a flat section of gel. The same gel can be used for the heel plug, arch plug and arch cushion.

Figure 10:
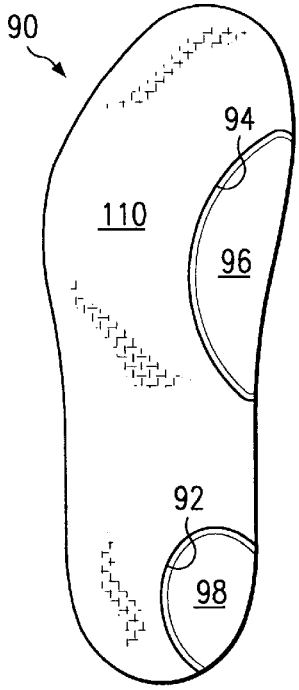
FIG. 10 is a top view of another embodiment of the insole sheet of the present invention.

As shown in FIG. 10, the insole 90 can be constructed such that the heel opening 92 and/or arch opening 94 for the arch plug 96 and/or heel plug 98 are not totally enclosed by the polymeric foam sheet 110. This embodiment is less preferred because the resulting insole is not as durable.

I claim:

1. An insole combination comprising:

(a) an insole sheet having
  (i) a sheet of polymeric foam material of a predetermined thickness having a top side and a bottom side and defining an arch opening;
  (ii) a polymeric gel filling said arch opening and having a thickness substantially the same as said thickness of said sheet of polymeric foam material having an exposed bottom surface; and (b) a polymeric gel formed in the shape of an arch and being removably adhered to the bottom surface of said polymeric gel filling said arch opening.

2. An insole of claim 1 wherein said sheet of polymeric foam material further defines a heel opening and further comprises a polymeric gel filling said heel opening and having a thickness substantially the same as said thickness of said sheet of polymeric foam material.

3. An insole of claim 1 wherein said exposed bottom surface of said polymeric gel is tacky.

4. An insole of claim 1 wherein the surface of said polymeric gel formed in the shape of an arch is tacky.

5. An insole of claim 3 wherein the surface of said polymeric gel formed in the shape of an arch is tacky.

6. An insole combination comprising:

(a) an insole sheet having
  (i) a sheet of polymeric foam material having a top side and a bottom side;
  (ii) a fabric cover attached to said top side of said sheet of polymeric foam material; said insole sheet having a predetermined thickness and defining an arch opening;

(b) a polymeric gel filling said arch opening and having a thickness substantially the same as said thickness of said insole sheet having an exposed bottom surface; and (c) a polymeric gel formed in the shape of an arch and being removably adhered to the bottom surface of said polymeric gel filling said arch opening.

7. An insole of claim 6 wherein said exposed bottom surface of said polymeric gel is tacky.

8. An insole of claim 6 wherein the surface of said polymeric gel formed in the shape of an arch is tacky.

9. An insole of claim 7 wherein the surface of said polymeric gel formed in the shape of an arch is tacky.

* * * * *